US008807405B2

(12) United States Patent
Crandall et al.

(10) Patent No.: US 8,807,405 B2
(45) Date of Patent: Aug. 19, 2014

(54) SELF ADJUSTING CONTOURED STRAP DEVICE AND METHOD

(75) Inventors: Kevin Crandall, Santa Rosa, CA (US); Luis Quehl, Santa Rosa, CA (US)

(73) Assignee: DayMen Canada Acquisition ULC, Vancouver, British Columbia (CA)

( * ) Notice: Subject to any disclaimer, the term of this patent is extended or adjusted under 35 U.S.C. 154(b) by 0 days.

(21) Appl. No.: 13/203,578

(22) PCT Filed: Feb. 26, 2010

(86) PCT No.: PCT/US2010/025692

§ 371 (c)(1), (2), (4) Date: Nov. 3, 2011

(87) PCT Pub. No.: WO2010/099506

PCT Pub. Date: Sep. 2, 2010

(65) Prior Publication Data

US 2012/0037674 A1 Feb. 16, 2012

Related U.S. Application Data

(60) Provisional application No. 61/155,787, filed on Feb. 26, 2009.

(51) Int. Cl.
*A45F 3/12* (2006.01)

(52) U.S. Cl.
USPC ..... 224/264; 224/257; 224/643; 2/268

(58) Field of Classification Search
CPC ..... A41D 27/26; A45F 3/12; A45F 3/14; A45F 2003/12; A45F 2003/14; A45F 2003/142
USPC ..... 224/254, 153, 175, 178, 264, 578, 627, 224/642, 643, 651, 257, 600, 625, 150; 383/6; 2/268, 460
See application file for complete search history.

(56) References Cited

U.S. PATENT DOCUMENTS

| | | | | | |
|---|---|---|---|---|---|
| 5,143,266 | A * | 9/1992 | Heckerman et al. | ..... | 224/150 |
| 5,361,957 | A * | 11/1994 | Weintraub | ..... | 224/264 |
| 5,544,795 | A * | 8/1996 | Perrin | ..... | 224/254 |
| 5,551,614 | A * | 9/1996 | Ham | ..... | 224/264 |
| 5,695,102 | A * | 12/1997 | Jackson | ..... | 224/264 |
| 6,449,815 | B1 * | 9/2002 | Spiller | ..... | 24/306 |
| 6,510,717 | B1 * | 1/2003 | Levi | ..... | 70/18 |
| 6,640,344 | B2 * | 11/2003 | D'Addario et al. | ..... | 2/268 |

* cited by examiner

*Primary Examiner* — Brian D Nash
*Assistant Examiner* — Corey Skurdal
(74) *Attorney, Agent, or Firm* — Medler Ferro PLLC

(57) ABSTRACT

Novel devices and methods are provided to dispense the load of a bag or case across a user's shoulder when the user attached a strap to the bag or case. The devices and methods provide a segmented tensile assembly to disperse the load of a bag or case uniformly across the user's body.

11 Claims, 5 Drawing Sheets

SELF ADJUSTING CONTOURED STRAP DEVICE AND METHOD

RELATED APPLICATIONS

The present application claims priority from U.S. Provisional Application Ser. No. 61/155,787 filed Feb. 26, 2009, which is incorporated herein by reference in its entirety for all purposes.

FIELD

The embodiments of the present invention relate generally to bags and cases for holding electronic equipment or other valuables. More specifically, embodiments of the present invention relate to improved straps to assist in carrying bags and cases.

BACKGROUND

Bags, satchels, purses, softcases, backpacks, side packs, hip packs, fanny packs, messenger bags and bags in general may be used for storing and or transporting electronic equipment or other valuables. Such bags and cases must have handles, straps, or other means to carry them. Often straps are positioned over the shoulder or around the user's neck. If the straps are not ergonomically well-designed carrying the bag or case by its strap may be uncomfortable for the user. Consumers desire to purchase bags and cases that not only properly store the intended contents, but that are also comfortable to carry. Embodiments of the present invention provide novel straps that adjust to the user's body structure to make a bag or case more comfortable to carry.

SUMMARY

In accordance with a preferred embodiment of the present invention, a strap for carrying a bag is provided. The device includes: an elongated member having a first side and a second side, at least two segmented pads, at least two clips for attaching the at least two segmented pads to the elongated member, a first material covering the first side of the elongated member and a top side of the at least two clips; and a second material covering the second side of the elongated member and the at least two segmented pads.

In accordance with another embodiment of the present invention, a method for dispersing the weight of a bag or case being carried is provided. The method includes: providing a segmented foam member; attaching the segmented foam member to a tensile webbing wherein the segmented foam member is attached using clips; attaching a foam sheet to the segmented foam member on the side opposite the clips, and covering the segmented foam member and clips with mesh.

Other and further features and advantages of the embodiments of the present invention will be apparent from the following descriptions of the various embodiments. It will be understood by one of ordinary skill in the art that the following embodiments are provided for illustrative and exemplary purposes only, and that numerous combinations and modification of the elements of the various embodiments of the present invention are possible.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of embodiments of the present invention, reference is made to the following Detailed Description, which is to be read in association with the accompanying drawings, wherein.

DETAILED DESCRIPTION OF EMBODIMENTS

The embodiments of the present invention are described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as systems, or devices. Moreover, the embodiments should not be interpreted as limited to bags or cases, such is merely provided for ease of understanding. The following detailed description is, therefore, not to be taken in a limiting sense.

Throughout the specification and claims, the following terms take the meanings explicitly associated herein, unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on." The term "coupled" implies that the elements may be directly connected together or may be coupled through one or more intervening elements.

Further, throughout the specification the term bag may be used, however, this is not intended to be used in a limiting sense and bags include but are not limited to satchels, purses, softcases, backpacks, side packs, hip packs, fanny packs, messenger bags and bags in general for storing and or transporting items.

Aspects of embodiments of the present invention may be implemented with an infinite variety of bag or cases. Embodiments of the straps described herein may be included as the original strap on a bag, or as a retrofit or replacement strap for a bag, or as an alternate strap for a bag having a shorter handle, or other strap.

Figure 1:
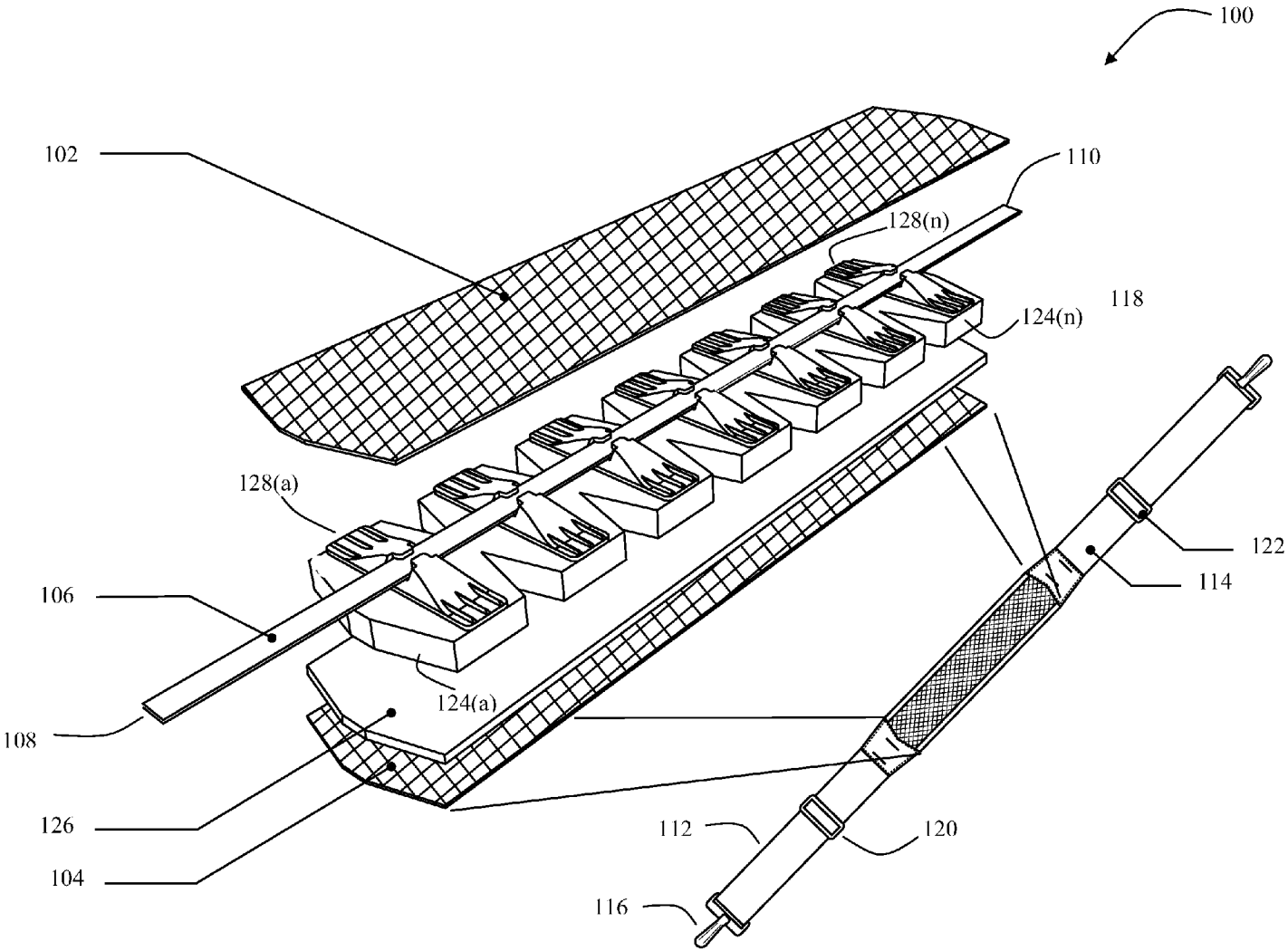
FIG. 1 is a perspective view of a strap in accordance with one embodiment of the present invention.

Turning to the drawings, FIG. 1 is an exploded view of a strap 100 in accordance with an embodiment of the present invention. The strap 100 includes a top cover 102 and a bottom cover 104. The top cover 102 may be constructed out of any textile material that is flexible and has elasticity such that it stretches and deforms and then return to its original size and shape. It may also be constructed from synthetic or semi-synthetic polymerization products, or other pliable or malleable substances so long as such is flexible and elastic. Preferably but not necessarily, the top cover 102 has perforations, for example preferably it has a mesh like structure (shown). More preferably the top cover 102 is constructed from a stretch mesh material. The bottom cover 104 may be constructed out of any textile material, that is flexible and has elasticity such that it stretches and deforms and then return to its original size and shape. It may also be constructed from synthetic or semi-synthetic polymerization products, or other pliable or malleable substances so long as such is flexible and elastic. The bottom cover 104 and/or the top cover 102 may optionally be constructed from a three dimensional mesh material as depicted. This mesh is not however intended to be a limitation on the embodiments of the present invention.

Between the top cover 102 and the bottom cover 104 lies an elongated member 106. The elongated member 106 may be constructed from any textile material that is flexible and has sufficient strength to support the "dead weight/hang weight" of the bag or case to which the strap is attached. The elongated member may also be constructed from synthetic or semi-synthetic polymerization products, however such materials are less preferred. Preferably, the elongated member 106 is constructed of a nylon webbing that may be deformed. More preferably, the elongated member is a tensile webbing. Preferably the elongated member is 10 mm wide. While 10 mm may be the preferred width, this is not intended to be a limitation on the width of the elongated member and various widths are contemplated within the scope of the embodiments of the present invention. The width may be greater or less depending on the desired strength of the strap 100 and its intended use. Preferably the width is between 5 mm and 20 mm. The elongated member 106 has a first end 108 and a second end 110. Attached to the first end 108 and the second end 110 of the elongated member 106 are narrow flat strips of a flexible material 112, 114 that are used to create a loop. The flat strips of a flexible material 112, 114 may be attached directly to the elongated member. Alternatively, the flat strips of a flexible material 112, 114 may be attached through the use of a connecting or coupling device or by coupling it with an alternate textile or material. Preferably the narrow flat strips of a flexible material 112, 114 are constructed of nylon webbing. Preferably the nylon webbing is 50 mm wide. While 50 mm may be the preferred width, this is not intended to be a limitation on the width of the flat strips of flexible materials and various widths are contemplated within the scope of the embodiments of the present invention. The width may be greater or less depending on the desired strength of the strap 100. Preferably the width is between 25 mm and 75 mm. The loop is created by feeding the narrow flat strips of flexible material 112, 114 through snap hooks or other coupling means members 116, 118. The coupling means 116, 118 enable the strap 100 to be connected or coupled to a bag or case. The coupling means 116, 118 may be constructed from a variety of materials including but not limited to fiberglass, metallic substances, synthetic or semi-synthetic polymerization products. The length of the loops created from the narrow flat strips of flexible material may be adjusted by sliding an adjusting loop 120, 122 along the length of the narrow flat strips 120, 122. Although the embodiment is described with loops created from the flat strips of flexible material, other coupling means are contemplated within the scope of the embodiments of the present invention including but not limited to buckles, clips, and metal loops.

Attached to the elongated member are multiple clips 128(*a* . . . *n*). The clips 128(*a* . . . *n*) are described in greater detail in conjunction with FIG. 4 herein. Secured to each clip 128(*a* . . . *n*) is a shock absorbing pad 124(*a* . . . *n*), as depicted the pads are segmented foam pads. The pads 124(*a* . . . *n*) may be constructed from any material which provides cushioning, is flexible, deformable and may absorb energy. Preferably the pads 124(*a* . . . *n*) are made from ethylene vinyl acetate foam. Preferably the ethylene vinyl acetate foam is 10 mm in thickness. While 10 mm may be the preferred thickness, this is not intended to be a limitation on the thickness of the cushioning material and various thicknesses are contemplated within the scope of the embodiments of the present invention. The thickness may be greater or less depending on the desired cushioning. Furthermore, although depicted as having uniform thickness, the pads 124(*a* . . . *n*) may have varying thickness, i.e., may be contoured. Although the pads 124(*a* . . . *n*) are depicted as octagonal in shape, this shape is not intended to be a limitation on the scope of the embodiments of present invention. It is contemplated that the pads 124(*a* . . . *n*) may be of any geometry and size as long as the pads 124(*a* . . . *n*) are larger in size than the clips 128(*a* . . . *n*) so that no clip 128(*a* . . . *n*) extends beyond the surface of the pad 124(*a* . . . *n*) on which it rests. The shape of the pad 124(*a* . . . *n*) is ergonomically designed to compliment a user's body. Although the strap 100 is depicted as having seven clips 128(*a* . . . *n*) and seven pads 124(*a* . . . *n*), this is not intended to be a limitation on the number of clips or pads contemplated within the scope of the embodiments of the present invention and there may be less or more depending on the size of the strap. The pads 124(*a* . . . *n*), clips 128(*a* . . . *n*) and the elongated member 106 form a segmented tensile assembly 500, FIG. 5.

Between the pads 124(*a* . . . *n*) and the bottom cover 104, is a length of soft cushioning material 126. Although a preferred embodiment comprises the cushioning material 126, the cushioning material is optional. The cushioning material 126 is preferably a piece of open cell foam. Preferably the open cell foam is 5 mm thick. While 5 mm may be the preferred thickness, this is not intended to be a limitation on the thickness of the cushioning material and various thicknesses are contemplated within the scope of the embodiments of the present invention. The thickness may be greater or less depending on the desired cushioning. The cushioning material 126, provides further cushioning of the strap 100 when placed around a user's neck or shoulder.

Figure 2:
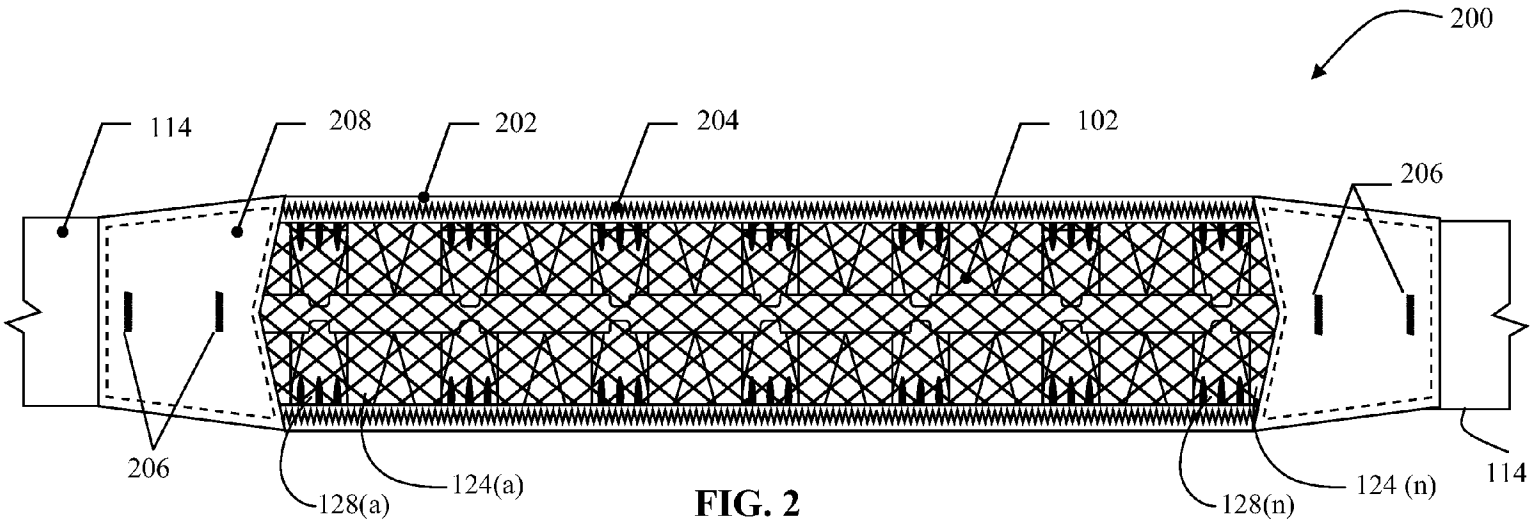
FIG. 2 is a top view of the strap of FIG. 1.

FIG. 2 is a top view 200 of the strap 100 of FIG. 1. As depicted in FIG. 2, the top cover 102 and the bottom cover 104 are bound together to create a pocket for holding the segmented tensile assembly 500. Preferably, the top cover 102 and the bottom cover 104 are bound together with an elastic webbing 202 or other elastic material using a stitch that is secure, for example a zigzag stitch 204. Alternate materials may be used to bind the top cover 102 and the bottom cover 104 provided such material is flexible and is capable of recovering its shape after it is deformed. Further, while described as stitched, the top cover 102 and bottom cover 104 may be bound by other means, including flexible adhesives, mechanical connections (hooks, snaps, etc) or any other means. The encased segmented tensile assembly 500 (as discussed below) is coupled to the flat strips of a flexible material 112, 114 by means of a bartack 206 or other reinforced sticking to a durable material 208 such as leather, vinyl, nylon, or reinforced textile material. Alternatively (not shown), the segmented tensile assembly 500 may be coupled directly to the flat strips of a flexible material 112, 114 by means of a mechanical connector such as a snap, buckle, clasp, button, or hook or by using such connectors to attach the segmented tensile assembly 500 to the durable material 206.

Figure 3:
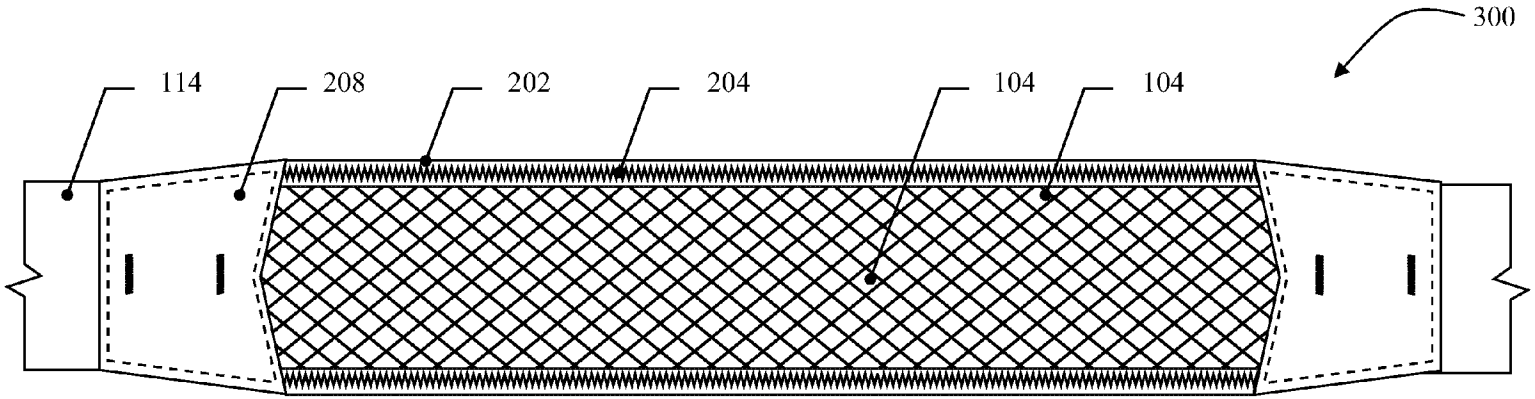
FIG. 3 is a bottom view of the strap of FIG. 1.

FIG. 3 is a bottom view 300 of the strap 100 of FIG. 1. As depicted in FIG. 3, the top cover 102 and the bottom cover 104 are bound together to create a pocket for holding the segmented tensile assembly. Preferably, the top cover 102 and the bottom cover 104 are bound together with an elastic webbing 202 or other elastic material using a stitch that is secure, for example a zigzag stitch 204 as described in conjunction with FIG. 2. The bottom cover 104 may be complimented with a nonslip material 308 such as polyurethane or rubber to prevent the assembly from slipping off the user's neck, shoulder, etc., while being carried by the user.

Figure 4:
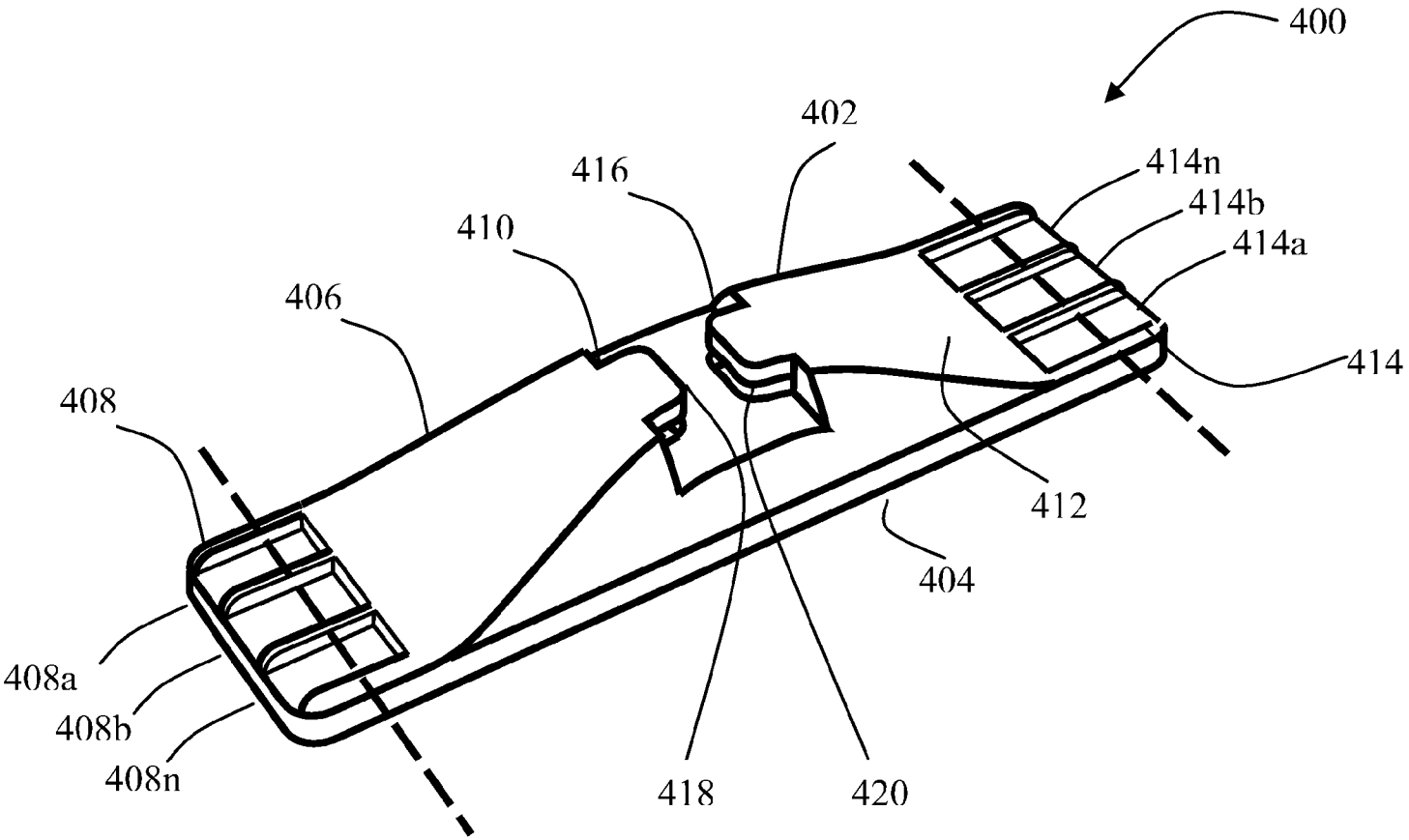
FIG. 4 is a perspective view of a clip for use in the strap of FIG. 1.

FIG. 4 is a perspective view of a clip 400 in accordance with one embodiment of the present invention. The clip 400 may be constructed from synthetic or semi-synthetic polymerization products, or other moldable, pliable or malleable substances. The clip 400 has a top side 402 and a bottom side 404. The top side 402 is comprised of two elements 406, 412. Although described as comprised of two elements, it is contemplated within the scope of the embodiments of the present invention that the two elements may be constructed as a single element having two parts. The two pieces 406, 412 each have a first end 408, 414 and a second end 410, 416. The top side pieces 406, 412 may be a tapered shape such that the thickness at the second end 410, 416 is thinner than the thickness at the first end 408, 414. Preferably the difference in thickness is substantial. For example the second end 408, 414 may be one third or less of the thickness at the second end 410, 416. The second ends 410, 416 of the top side pieces connect with the bottom side 404. The top side of the top side piece 406, 412 at the second end 410, 416 optionally has grooves 408(*a* . . . *n*), 414(*a* . . . *n*). Grooves 408(*a* . . . *n*) and 414(*a* . . . *n*) assist in reinforcing the clip between needle strikes (when the assembly is sewn together.) The joining of the fabric, helps to prevent the cover from slipping. Still further the grooves 408(*a* . . . *n*), 414(*a* . . . *n*) may assist in preventing a fabric cover from slipping along the clip 400. Although the clip 400 is depicted generally as rectangular, this geometry is not intended to be a limitation on the shape of the clip 400. The clip geometry may vary so long as it is configured to hold the elongated member.

The second end 408, 414 of the top side piece 406, 412 has a tab 418, 420. Although depicted as a rectangular shaped tab with rounded corners, the geometry of the tabs as shown is not intended to be a limitation on the scope of the embodiment of the present invention. The tab may be of varying geometry, it may be semi-circular, triangular, square or any other shape, it may also be irregular in shape. Regardless of the shape, the tab must be of such a size, shape and proportion that the elongated member 106 inserted between the top side pieces 416, 412 will be remain between and beneath the tabs 418, 420.

In one embodiment, the two top side pieces 406, 412 are of a constant thickness (not shown). If the top side pieces 406, 412 are of a constant thickness, then a support structure is provided so that a ramp like structure is created sloping from a first end down to a second end. In this embodiment, a support structure (not shown) is provided for the elongated member while it lies between the top side pieces.

Figure 6:
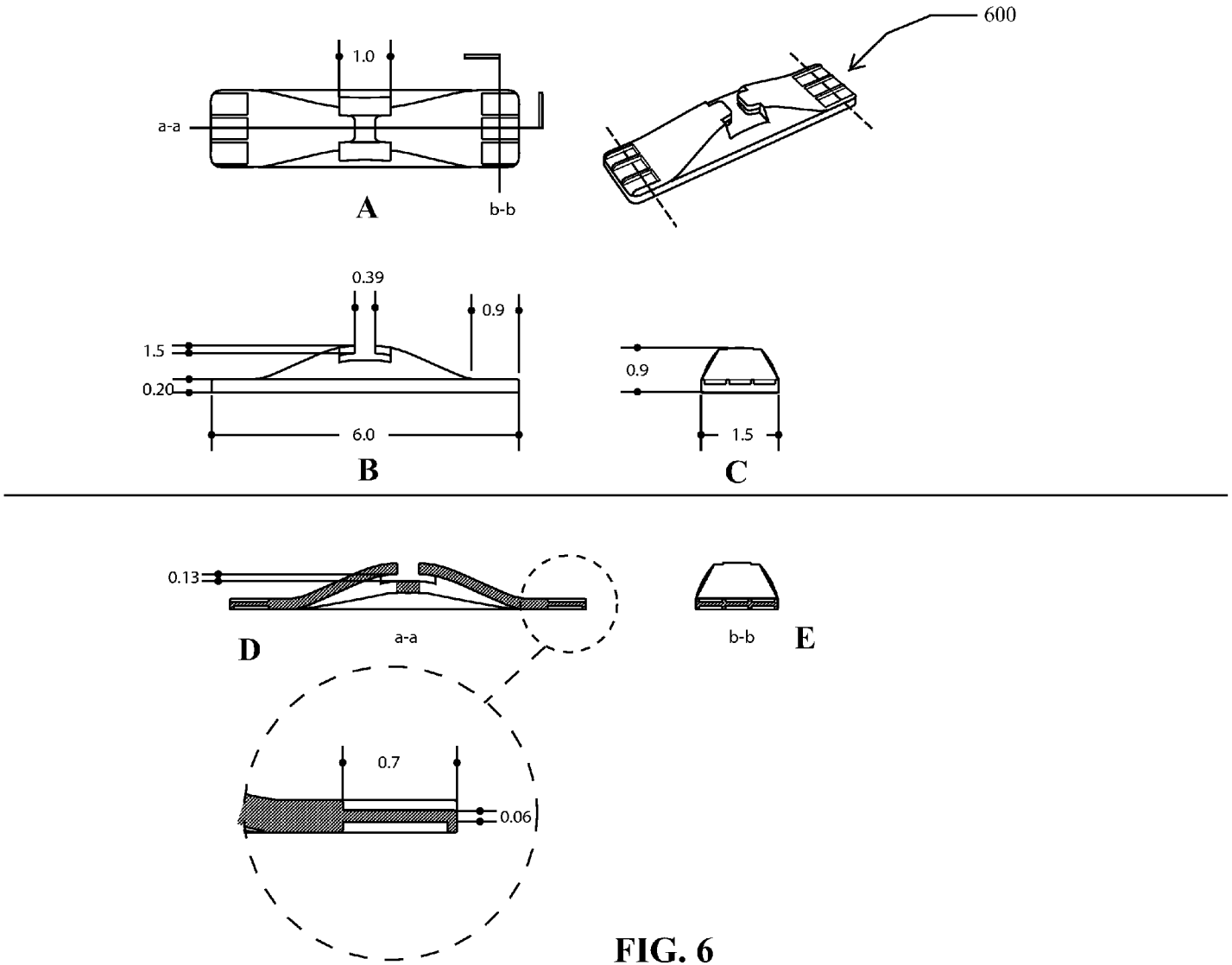
FIG. 6 is multiple views of a clip in accordance with an embodiment of the present invention.

In a preferred embodiment, the clip 400 is 6 cm in length and 1.5 cm in width. At the ends 410 and 416, preferably the thickness is 0.20 cm. The distance between the tabs 418, 420 is preferable 0.39 cm and the thickness of each tab 418, 420 is preferably 0.15 cm. If grooves are provided for at the ends 410, 416, preferably each groove length is 0.7 cm and its depth is 0.06 cm. An embodiment depicting such preferred dimensions of a clip 600 is provided in FIG. 6. In FIG. 6, "A" depicts a top view of the clip 600, "B" depicts a side view of the clip 600, and "C" depicts an end view of the clip 600. Specific cross-section are depicted in D and E. The above dimensions are provided for exemplary purposes only and as such are not intended to be a limitation on the embodiments of the present invention. The dimension dimensions may be larger or smaller. In preferred embodiments such lengths/dimensions are proportionately scaled.

Figure 5A:
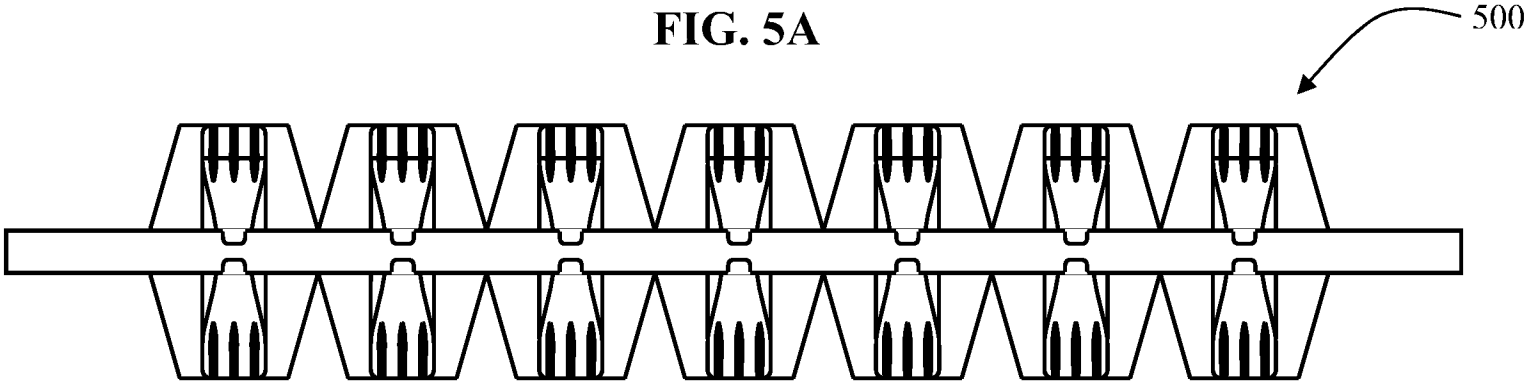
FIGS. 5A and 5B are top views of a contouring mechanism for use in one embodiment of the strap of FIG. 1.
Figure 5B:
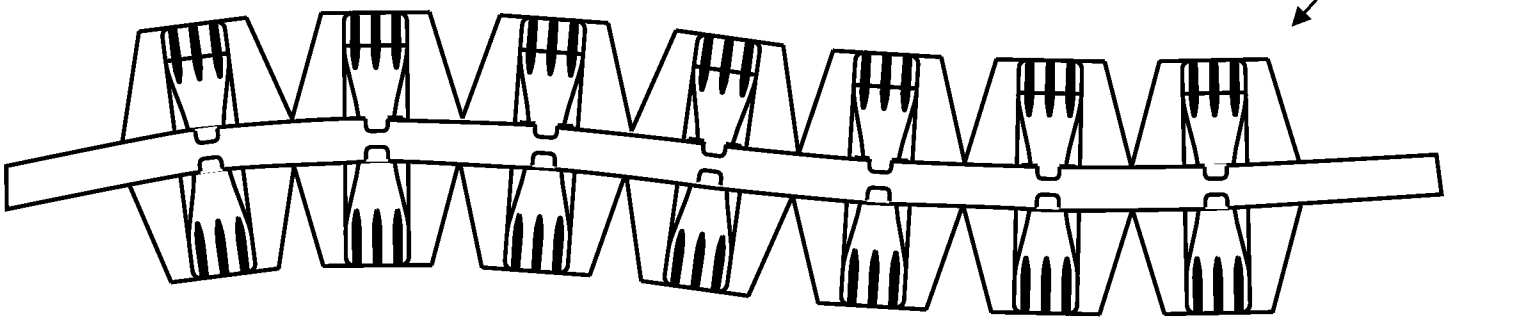

FIGS. 5A and 5B are top views of an internal contouring mechanism in accordance with an embodiment of the present invention. FIG. 5A depicts the segmented tensile assembly 500 in a relaxed state while FIG. 5B depicted the segmented tensile assemble 502 in a deformed state, for example when the assembly is adjusting to the user's body. As shown the segmented assembly may deform in multiple directions.

Conventional straps are either straight or have a preformed curve shape. Straight straps do not conform to the wearer's body. This results in uneven loading of the weight of the bag on the wearer's body. Preformed curve straps conform to the user's shoulders well when worn with the pad on the shoulder opposite the bag, i.e., when the strap crosses the wearer's body diagonally. However, when a preformed curve strap is worn on the same side of the body as the bag, the curved strap tends to tilt so that one edge bears down on the wearer's shoulder. As a result, the load of the bag is placed along a narrow line, which can create discomfort for a user. The embodiments of the present invention utilize a novel segmented tensile assembly and novel clip to create a self adjusting strap that contours to the shape of the wearer's body. The strap is able to match the wearer's body because of its novel segmented foam construction and the tensile webbing around which the segments may move freely. Moreover, the clips which couple the webbing to the segmented foam spread the load over the full width of the foam padding.

Although described as a neck or shoulder strap, such uses are not intended to be a limitation on the present invention. The novel strap could also be implemented as a waist strap, back-pack strap, seatbelt, or any other strap or holding configuration. Furthermore, while the embodiments of the present invention are intended for use by humans, alternative configurations of the device are contemplated within the scope of the present invention so that such device could be used by animals As noted previously the forgoing descriptions of the specific embodiments are presented for purposes of illustration and description. They are not intended to be exhaustive or to limit the invention to the precise forms disclosed and obviously many modifications and variations are possible in view of the above teachings. The embodiments were chosen and described in order to explain the principles of the invention and its practical applications, to thereby enable those skilled in the art to best utilize the invention and various embodiments thereof as suited to the particular use contemplated. It is intended that the scope of the invention be defined by the claims and their equivalents.

The invention claimed is:

1. A strap for carrying a bag comprising:

an elongated member having a longitudinal axis, a first side and a second side, and a first end and a second end;

at least two segmented pads, wherein each pad is disposed substantially transverse to the longitudinal axis of the elongated member;

at least two clips for coupling the at least two segmented pads to the elongated member, wherein the at least two clips are coupled to the elongated member such that the at least two clips are substantially transverse to the longitudinal axis of the elongated member, wherein each clip includes a bottom side attached to a first surface of one of the at least two segmented pads, and a top side having a groove therein defined by a groove bottom surface facing a direction opposite the bottom side of the clip and two groove side surface, and a first tab extending from one of the two groove side surfaces, wherein the elongated member is disposed within the groove of each clip in a spaced defined between the groove bottom surface and the first tab;

a first material covering the first side of the elongated member and the top side of the at least two clips; and a second material covering the second side the elongated member and the at least two segmented pads.

2. The strap of claim 1, further comprising:

a cushioning material between the at least two segmented pads and the second material.

3. The strap of claim 1, wherein the first material and the second material are a mesh material.

4. The strap of claim 1, further comprising:

a first flexible material coupled to the first end; and a second flexible material coupled to the second end.

5. The strap of claim 1, wherein the elongated member comprises a deformable material.

6. The strap of claim 1, wherein a second tab extends from the other of the two groove side surfaces.

7. A strap for carrying a bag comprising:

an elongated member having a longitudinal axis, a first side and a second side, and a first end and a second end;

a segmented pad having at least two segments, wherein each segment is disposed substantially transverse to the longitudinal axis of the elongated member;

at least two clips for coupling the at least two segments to the elongated member, wherein the at least two clips are coupled to the elongated member such that the at least two clips are substantially transverse to the longitudinal axis of the elongated member, wherein each clip includes a bottom side attached to a first surface of one of the segments of the segmented pad, and a top side having a groove therein defined by a groove bottom surface facing a direction opposite the bottom side of the clip and two groove side surfaces, and a first tab extending from one of the two groove side surfaces, wherein the elongated member is disposed within the groove of each clip in a space defined between the groove bottom surface and the first tab;

a first material covering the first side of the elongated member and the top side of the at least two clips; and a second material covering the second side the elongated member and the pad.

8. The strap of claim 7, further comprising:

a cushioning material between the segmented-pad and the second material.

9. The strap of claim 7, further comprising:

a first flexible material coupled to the first end of the elongated member; and a second flexible material coupled to the second end of the elongated member.

10. The strap of claim 7, wherein the elongated member comprises a deformable material.

11. The strap of claim 7, wherein a second tab extends from the other of the two groove side surfaces.

* * * * *